US010661523B2

(12) United States Patent
Wetsch et al.

(10) Patent No.: US 10,661,523 B2
(45) Date of Patent: May 26, 2020

(54) TEAR-ASSIST APPARATUS

(71) Applicant: Pregis Innovative Packaging LLC, Deerfield, IL (US)

(72) Inventors: Thomas D Wetsch, St Charles, IL (US); Christopher M Rains, New Lenox, IL (US); Robert Tegel, Huntley, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 735 days.

(21) Appl. No.: 15/018,424

(22) Filed: Feb. 8, 2016

(65) Prior Publication Data

US 2016/0151991 A1 Jun. 2, 2016

Related U.S. Application Data

(63) Continuation of application No. 13/623,874, filed on Sep. 20, 2012, now Pat. No. 9,254,578.
(Continued)

(51) Int. Cl.
*B31D 5/00* (2017.01)
*B26D 5/20* (2006.01)
(Continued)

(52) U.S. Cl.
CPC ..... *B31D 5/0043* (2013.01); *A47K 10/32* (2013.01); *B26D 5/20* (2013.01); *B26D 5/38* (2013.01);
(Continued)

(58) Field of Classification Search
CPC .... A47K 10/00; A47K 10/36; A47K 10/3618; A47K 10/3643; A47K 10/32; B31D 5/00;
(Continued)

(56) References Cited

U.S. PATENT DOCUMENTS 3,001,735 A 9/1961 Francik
3,052,146 A 9/1962 Glendening
(Continued)

FOREIGN PATENT DOCUMENTS

DE 19520907 1/1996
EP 1026113 A2 8/2000
(Continued)

OTHER PUBLICATIONS

Communication Pursuant to Article 94(3) EPC, dated Dec. 21, 2015 in EP App No. 11809054.7.
(Continued)

*Primary Examiner* — Jennifer B Swinney
*Assistant Examiner* — Richard D Crosby, Jr.
(74) *Attorney, Agent, or Firm* — Fox Rothschild LLP

(57) ABSTRACT

A system for processing a line of material along a path and a tear-assist apparatus. The tear-assist comprising a driving portion that drives the line of material along the path, a sensing unit that detects pulling of the line of material in a first direction along the path away from the driving portion, and a cutting member for cutting the line of material. The driving portion can also be configured to drive the line of material in the first direction along the path to dispense the material.

18 Claims, 9 Drawing Sheets

Related U.S. Application Data

(60) Provisional application No. 61/537,021, filed on Sep. 20, 2011.

(51) Int. Cl.

| | |
|---|---|
| ***B26D 5/38*** | (2006.01) |
| ***A47K 10/32*** | (2006.01) |
| ***B26F 3/02*** | (2006.01) |
| ***B26D 5/00*** | (2006.01) |

(52) U.S. Cl.
CPC ..... *B26F 3/02* (2013.01); *B26D 5/00* (2013.01); *B31D 2205/007* (2013.01); *B31D 2205/0058* (2013.01); *Y10T 225/282* (2015.04)

(58) Field of Classification Search
CPC .. B31D 5/0039; B31D 5/0043; B31D 5/0047; B31D 5/0052
USPC ..... 225/8, 10–16, 72–74
See application file for complete search history.

(56) References Cited

U.S. PATENT DOCUMENTS

| | | | | |
|---|---|---|---|---|
| 3,509,797 | A | 5/1970 | Johnson | |
| 3,509,798 | A | 5/1970 | Johnson | |
| 3,542,268 | A | 11/1970 | Schramm | |
| 4,450,996 | A | 5/1984 | Kamp | |
| 4,598,531 | A | 7/1986 | Ruff et al. | |
| 4,699,609 | A | 10/1987 | Komaransky et al. | |
| 5,078,311 | A | 1/1992 | Taguchi et al. | |
| 5,131,903 | A | 7/1992 | Levine et al. | |
| 5,188,581 | A | 2/1993 | Baldacci | |
| 5,219,126 | A | 6/1993 | Schutz | |
| 5,232,430 | A | 8/1993 | Nitsch | |
| 5,322,477 | A | 6/1994 | Armington et al. | |
| 5,377,570 | A | 1/1995 | Giljam | |
| 5,439,730 | A | 8/1995 | Kelly et al. | |
| 5,474,250 | A | 12/1995 | Birkmann et al. | |
| 5,829,231 | A | 11/1998 | Harding et al. | |
| 5,864,484 | A | 1/1999 | Harding | |
| 6,179,765 | B1 | 1/2001 | Toth | |
| 6,237,449 | B1 | 5/2001 | Orlosky | |
| 6,378,800 | B1 | 4/2002 | Apichom | |
| 6,524,230 | B1 * | 2/2003 | Harding | B31D 5/0047 493/464 |
| 6,632,165 | B1 | 10/2003 | Letourneau et al. | |
| 6,632,311 | B1 | 10/2003 | Glenna et al. | |
| 6,695,247 | B2 | 2/2004 | Widlund | |
| 6,702,212 | B2 | 3/2004 | Abba et al. | |
| 6,756,096 | B2 | 6/2004 | Harding | |
| 6,790,302 | B2 | 9/2004 | Beck et al. | |
| 6,802,467 | B2 | 10/2004 | Abba et al. | |
| 6,887,329 | B2 | 5/2005 | Harding | |
| 6,981,352 | B2 | 1/2006 | Chow et al. | |
| 7,066,422 | B1 | 6/2006 | Slocum | |
| 7,186,208 | B2 * | 3/2007 | Demers | B26F 3/02 493/350 |
| 7,407,471 | B2 | 8/2008 | Demers et al. | |
| 7,479,100 | B2 | 1/2009 | Toth | |
| 7,481,163 | B2 | 1/2009 | Theilacker | |
| 7,484,341 | B2 | 2/2009 | Konno | |
| 7,651,455 | B2 * | 1/2010 | Yampolsky | B26F 1/22 493/407 |
| 8,554,363 | B2 | 10/2013 | Sperry et al. | |
| 8,555,761 | B2 | 10/2013 | Keily et al. | |
| 8,820,238 | B2 | 9/2014 | Brandenburg et al. | |
| 9,254,578 | B2 * | 2/2016 | Wetsch | B26F 3/02 |
| 9,457,982 | B2 * | 10/2016 | Wetsch | B65H 35/008 |
| 2002/0091053 | A1 * | 7/2002 | Kung | B31D 5/0047 493/350 |
| 2003/0073558 | A1 | 4/2003 | Chesterson et al. | |
| 2003/0092552 | A1 * | 5/2003 | Armington | B31D 5/0047 493/464 |
| 2004/0142806 | A1 | 7/2004 | Coppus et al. | |
| 2005/0181924 | A1 | 8/2005 | Demers | |
| 2005/0247220 | A1 * | 11/2005 | Brandenburg | B26D 5/20 101/226 |
| 2007/0117703 | A1 * | 5/2007 | Cavaliere, Jr. | B31D 5/0052 493/464 |
| 2007/0117704 | A1 | 5/2007 | Toth | |
| 2007/0287623 | A1 * | 12/2007 | Carlson | B31D 5/0047 493/464 |
| 2008/0076653 | A1 * | 3/2008 | Shaw | B31D 5/006 493/464 |
| 2008/0207421 | A1 | 8/2008 | Wetsch | |
| 2008/0261794 | A1 | 10/2008 | Slovencik | |
| 2009/0026306 | A1 | 1/2009 | Kempster et al. | |
| 2009/0231123 | A1 | 9/2009 | Rowell et al. | |
| 2010/0127112 | A1 | 5/2010 | Aquarius | |
| 2010/0132529 | A1 | 6/2010 | Miyazaki | |
| 2011/0053750 | A1 * | 3/2011 | Wetsch | B31D 5/0052 493/464 |
| 2011/0281711 | A1 * | 11/2011 | Chan | B31D 5/0047 493/464 |
| 2012/0035038 | A1 | 2/2012 | Lembach et al. | |
| 2012/0165172 | A1 | 6/2012 | Wetsch et al. | |
| 2012/0329629 | A1 | 12/2012 | Wetsch et al. | |
| 2014/0274647 | A1 * | 9/2014 | Wetsch | B31D 5/0043 493/464 |
| 2015/0014205 | A1 | 1/2015 | Yap et al. | |
| 2017/0095991 | A1 * | 4/2017 | Wetsch | B31D 5/0043 |
| 2018/0326689 | A1 * | 11/2018 | Wetsch | B31D 5/0052 |

FOREIGN PATENT DOCUMENTS

| | | | |
|---|---|---|---|
| FR | 2667854 | | 10/1990 |
| FR | 2808726 | A1 | 11/2001 |
| GB | 2173141 | A | 10/1986 |
| JP | 60100361 | | 7/1985 |
| JP | 0310788 | | 1/1991 |
| JP | 07108488 | | 4/1995 |
| JP | 07252010 | A | 10/1995 |
| JP | 10-507134 | A | 7/1998 |
| JP | 2007-530317 | A | 11/2007 |
| WO | 2005/007394 | A3 | 5/2005 |

OTHER PUBLICATIONS

Examination Report dated Feb. 17, 2016 in CA App No. 2849084.
European Patent Office; Written Opinion for PCT/US2011/067235, 11 Pages.
European Patent Office, International Search Report for PCT/US2011/067235, 7 pages.
"Chinese Office Action for Chinese Patent Application No. 201280056327.X", Chinese Office Action for Chinese Patent Application No. 201280056327.X, dated Sep. 22, 2015 (7 pages).
Prosecution Document, "U.S. Non-Final Office Action", U.S. Non-Final Office Action dated Nov. 25, 2014, U.S. Appl. No. 13/623,874, 14 pages.
Chinese Office Action for Chinese Patent Application No. 201280056327.X, Chinese Office Action for Chinese Patent Application No. 201280056327.X, dated Apr. 5, 2016 (5 pages).
Extended European Search Report, EP application 17185878.0, dated Feb. 9, 2018, 9 pages.
Communication pursuant to Article 94(3) EPC dated Oct. 20, 2016, International Application No. 12833414.1, 2 pages.
Japanese Office Action for Japanese Patent Application No. 2014-531984, dated Nov. 8, 2016, 6 pages.
Canadian Office Action for Canadian Patent Application No. 2,849,084, dated Jan. 17, 2017, 3 pages.

* cited by examiner

TEAR-ASSIST APPARATUS

CROSS REFERENCE TO RELATED APPLICATION(S)

The present application claims priority from U.S. Patent Application No. 61/537,021 entitled "Tear-Assist Apparatus," filed Sep. 20, 2011, the disclosure of which is incorporated herein by reference in its entirety. U.S. Pat. No. 9,254,578 issued Feb. 9, 2016," which is also hereby incorporated by reference in its entirety.

TECHNICAL FIELD

An apparatus for processing a line of material is disclosed. More particularly, an apparatus for assisting a user in tearing the line of material at a desired point therealong is disclosed.

BACKGROUND

In the context of paper-based protective packaging, rolls of paper sheet are crumpled to produce the dunnage. Most commonly, this type of dunnage is created by running a generally continuous strip of paper into a dunnage conversion machine that converts a compact supply of stock material, such as a roll or stack of paper, into a lower density dunnage material. The continuous strip of crumpled sheet material may be cut into desired lengths to effectively fill void space within a container holding a product. The dunnage material may be produced on an as needed basis for a packer. Examples of cushioning product machines that feed a paper sheet from an innermost location of a roll are described in U.S. Patent Publication Nos. 2008/0076653 and 2008/0261794. Another example of a cushioning product machine is described in U.S. Patent Publication No. 2009/0026306.

At a selected point along the processed line of material, a user may wish to sever the line so as to separate the line into two or more portions. Existing processing systems require the user to pull the line against a cutting member in order to sever a portion therefrom. Such pulling requires the user to exert a force against the line.

It would therefore be desirable to employ a line processing apparatus and system with a tear-assist apparatus. In particular, it would be desirable to employ an apparatus that lessens the force required of a user to sever a processed line of material at a desired point.

SUMMARY

One embodiment includes a system for processing a line of material along a path and a tear-assist apparatus. The tear-assist comprising a driving portion that drives the line of material along the path, a sensing unit that detects pulling of the line of material in a first direction along the path away from the driving portion, and a cutting member for cutting the line of material. The sensing unit can be associated with the driving portion such that upon detecting movement of the line in the first direction, the sensing unit causes the driving portion to drive the line of material in a second direction along the path for drawing the line of material against the cutting member to cut the line of material. In another configuration, when the sensing unit detects the movement in the first direction, the sensing unit can cause the driving portion to drive the line of material in the second direction sufficiently for severing the portion of the line of material. The driving portion can also be configured to drive the line of material in the first direction along the path to dispense the material.

In yet other configurations, the system can further have a converting station that includes the driving portion and is operable in the first direction for converting supply material into low-density dunnage and moving the dunnage in a dispensing direction along a material path. The cutting member can cut the dunnage when the driving member draws the material thereagainst.

In another embodiment of the dunnage converting apparatus, the converting apparatus can have a converting station that is operable in a converting direction for converting supply material into low-density dunnage and moving the dunnage in a dispensing direction along a material path. The converting apparatus can also have a cutting member that divides the path and the dunnage therein into an outfeed portion between the converting station and the cutting member and a severable portion beyond the cutting member from the converting station. The dunnage converting apparatus can also have a sensing unit configured to detect a pulling of the dunnage severable portion of the path against the cutting member. The converting station can also be operable in a reverse direction for pulling the dunnage against the cutting member to cause the cutting member to cut the dunnage when the dunnage severable portion is pulled against the cutting member at an angle to the outfeed portion. The sensing unit can also be operably associated with the converting station for causing the converting station to operate in the reverse direction upon detecting the pulling.

In another embodiment, the converting station of the can include a drum and a pressing portion that presses against the drum on an opposite side of the path therefrom to engage the material, and the drum can be driven in the converting and reverse directions. The pressing portion can also include a roller biased against the drum.

In yet another apparatus of claim 5, wherein the converting station is configured to operate in the reverse direction sufficiently to sever the dunnage in the severable portion of the path. The cutting member can also have a blade that extends laterally next to the path. In other embodiments, the cutting member can be disposed on a single lateral side of the path.

In another embodiment, the path can be bent at the cutting member such that the outfeed and severable portions are out of alignment. The sensor can also be configured for detecting the resultant force of the dunnage in the bent path against the cutting member. In one embodiment, the sensing unit can detect a force against the cutting member to detect the pulling of the dunnage. The force against the cutting member that is detected by the sensing unit can be in a direction laterally away from the dunnage path. In other embodiments, the cutting member can comprise a movable blade, and the sensor can detect displacement of the blade away from the path.

In yet another embodiment, the force detected by the sensing unit can result from pulling on the severable portion of the dunnage in a direction such that the path is bent at the cutting member so that the outfeed and severable portions are out of alignment.

In another embodiment, the sensing unit can detect the pulling of the dunnage by detecting movement of the material in the converting station in the dispensing direction caused by an external force. In other configurations, the converting station can include a rotating member that drives the material in the dispensing direction while the converting station converts the material into dunnage, and the sensing unit can detect the pulling of the dunnage by detecting movement of the rotating member caused by an external force.

In other embodiments, the cutting member can be connected to the converting station, such that a movement of the driving portion in the reverse direction causes a corresponding movement of the cutting member into the dunnage in the path.

In another embodiment, the dunnage converting apparatus can have a converting station that can be operable in a converting direction for converting supply material into low-density dunnage and moving the dunnage in a dispensing direction along a material path and a cutting member that can be disposed on a single lateral side of the material path. The cutting member can divide the path and dunnage therein into an outfeed portion between the converting station and the cutting member, and a severable portion beyond the cutting member from the converting station. The converting station can be operable in a reverse direction for pulling the dunnage against the cutting member to cause the cutting member to cut the dunnage when the dunnage in the severable portion is pulled against the cutting member at an angle to the outfeed portion.

In another embodiment, the converting station can have a drum and a pressing portion that presses against the drum on an opposite side of the path therefrom to engage the material. The drum can be driven in the converting and reverse directions. The pressing portion can also comprise a roller biased against the drum. The converting apparatus can also have a sensing unit configured to detect a pulling of the dunnage in the severable portion of the path against the cutting member. The sensing unit can be operably associated with the converting station for causing the converting station to operate in the reverse direction upon detecting the pulling. In other configurations, the converting station can operate in the reverse direction sufficiently to sever the dunnage in the severable portion of the path.

A method for processing a line of material can include converting supply material into low-density dunnage and moving the dunnage in a dispensing direction along a material path, detecting a pulling of the dunnage at a severable portion of the path against a cutting member, and responding to said detection by pulling the dunnage against the cutting member in a reverse direction, thereby causing the cutting member to cut the dunnage when the dunnage in the severable portion is pulled against the cutting member at an angle to the outfeed portion. Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION OF PREFERRED EMBODIMENTS

An apparatus for processing a line of material is disclosed. More particularly, an apparatus for assisting a user in tearing the line of material at a desired point therealong is disclosed. The present disclosure is generally applicable to systems and apparatus where supply material, preferably being a line of material, is processed. In an example system, the line of material originates from a source repository, where the line of material is stored in a roll (whether drawn from inside or outside the roll), a wind, a fan-folded source, or any other form. In one embodiment, the line of material can be perforated. The line of material is then processed, which can include driving the line of material in a first direction, which can be a dispensing direction. In one example system, the line of material is fed from the repository through a drive roller in a dispensing direction, which is further discussed below, so as to dispense the line of material in said direction. The supply material can also be other types of protective packaging including other dunnage and void fill materials, and inflatable packaging pillows. A particular application of the apparatus described herein is the processing of dunnage material for packaging. Other applications can also be used, including lines of other paper or fiber-based materials in sheet form, lines of wound fiber material such as ropes or thread, and lines of thermoplastic materials such as a web of plastic material usable to form pillow packaging material.

Figure 1:
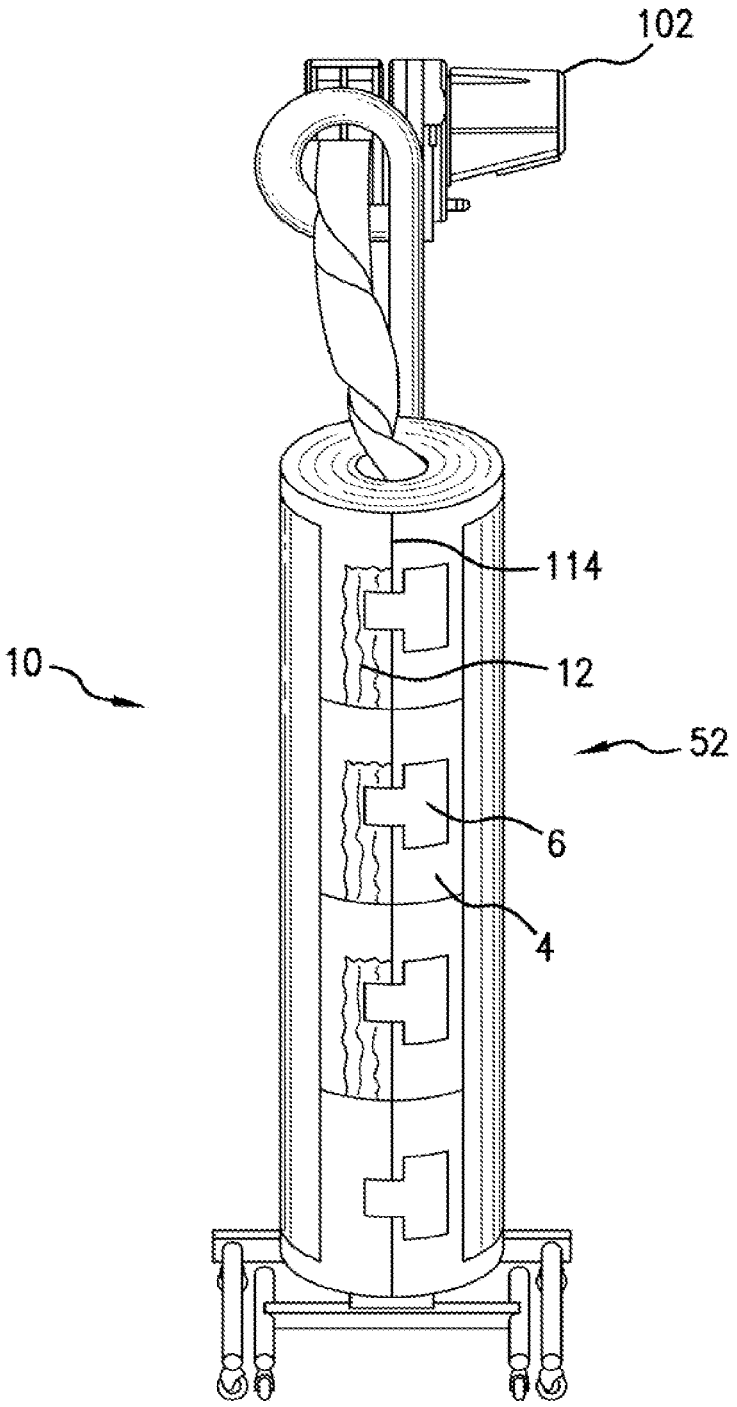
FIG. 1 is the rear view of an embodiment of a line processing system and supply station.
Figure 2:
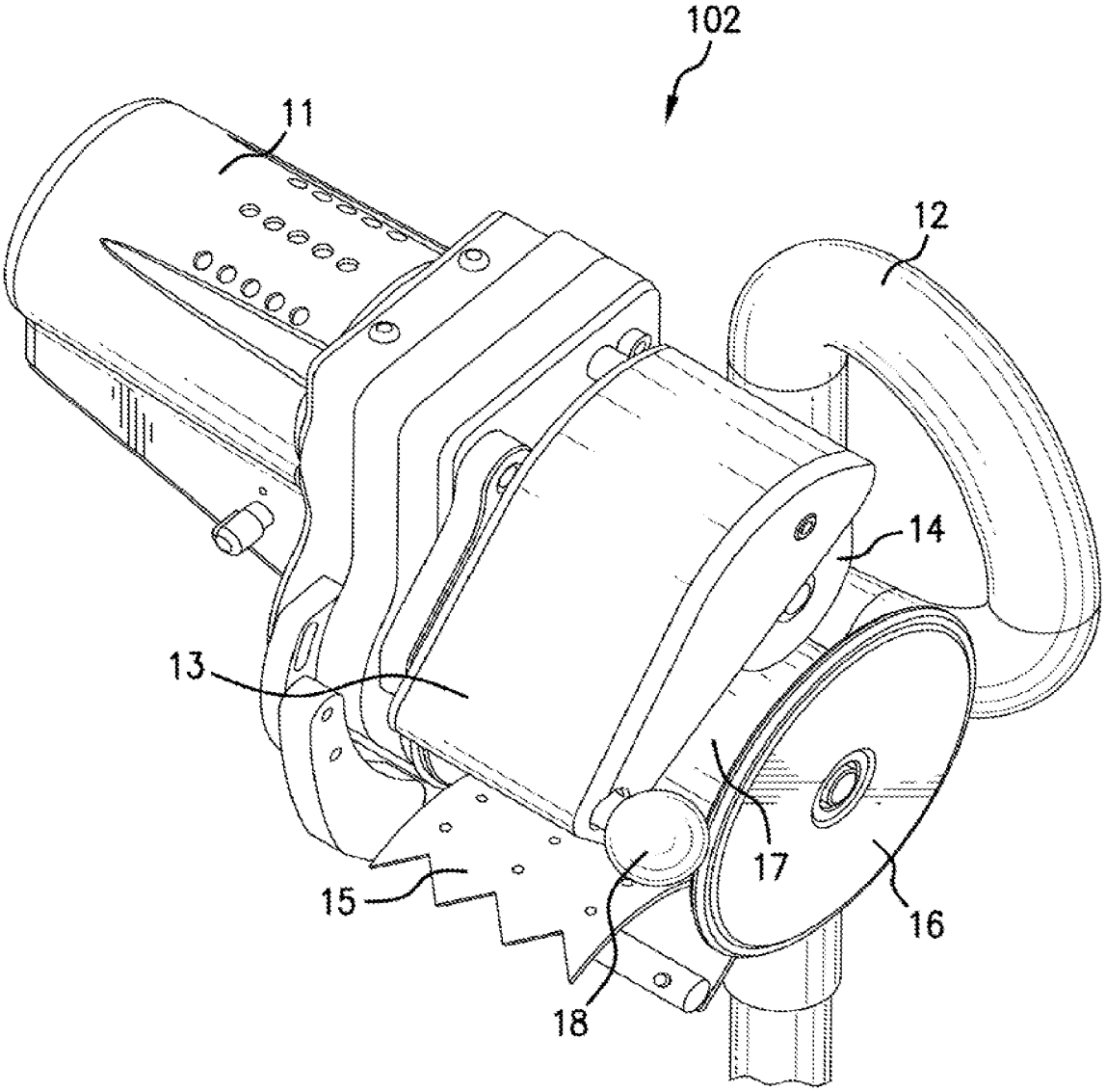
FIG. 2 is a front view of an embodiment of a line processing system with a tear assist apparatus employed thereon in accordance with the present disclosure.

With reference to FIGS. 1 through 3, a line processing system 10 is disclosed for processing a supply material. The system shown includes a tear-assist apparatus for assisting a user in tearing or severing material at a desired point. In the preferred embodiment, the supply material is a line of material 19, as shown in FIG. 3. The line of material 19 is fed from the supply side of the converting station 102, which is converted by the converting station 102, and then dispensed in a dispensing direction on the outfeed side of the converting station. As described further below, the line material 19 preferably includes a line of sheet material wound upon itself to form a roll that is later converted into dunnage. Multiple rolls can be daisy-chained together.

FIG. 1 depicts one embodiment of the system 10. In this embodiment, the system 10 is configured to pull a continuous stream of supply material, preferably a line of material 19, from a supply station. The system 10 is configured to pull a continuous stream from the supply station and into a converting station 102, where the converting station 102 converts the high-density configuration into a low-density configuration. The material can be converted by crumpling, folding, flattening, or other similar methods that converts high-density configuration to a low-density configuration.

Further, it is appreciated that various structures of the converting station 102 can be used, such as those converting stations 102 disclosed in U.S. Publication 2012/0165172, U.S. Publication No. 2011/0052875, and U.S. Pat. No. 8,016,735. In one embodiment, the system 10 is particularly adapted for pulling the sheet material from a center of a roll of sheet material creating a coiled stream of material entering the system 10, which is further described below.

Figure 3A:
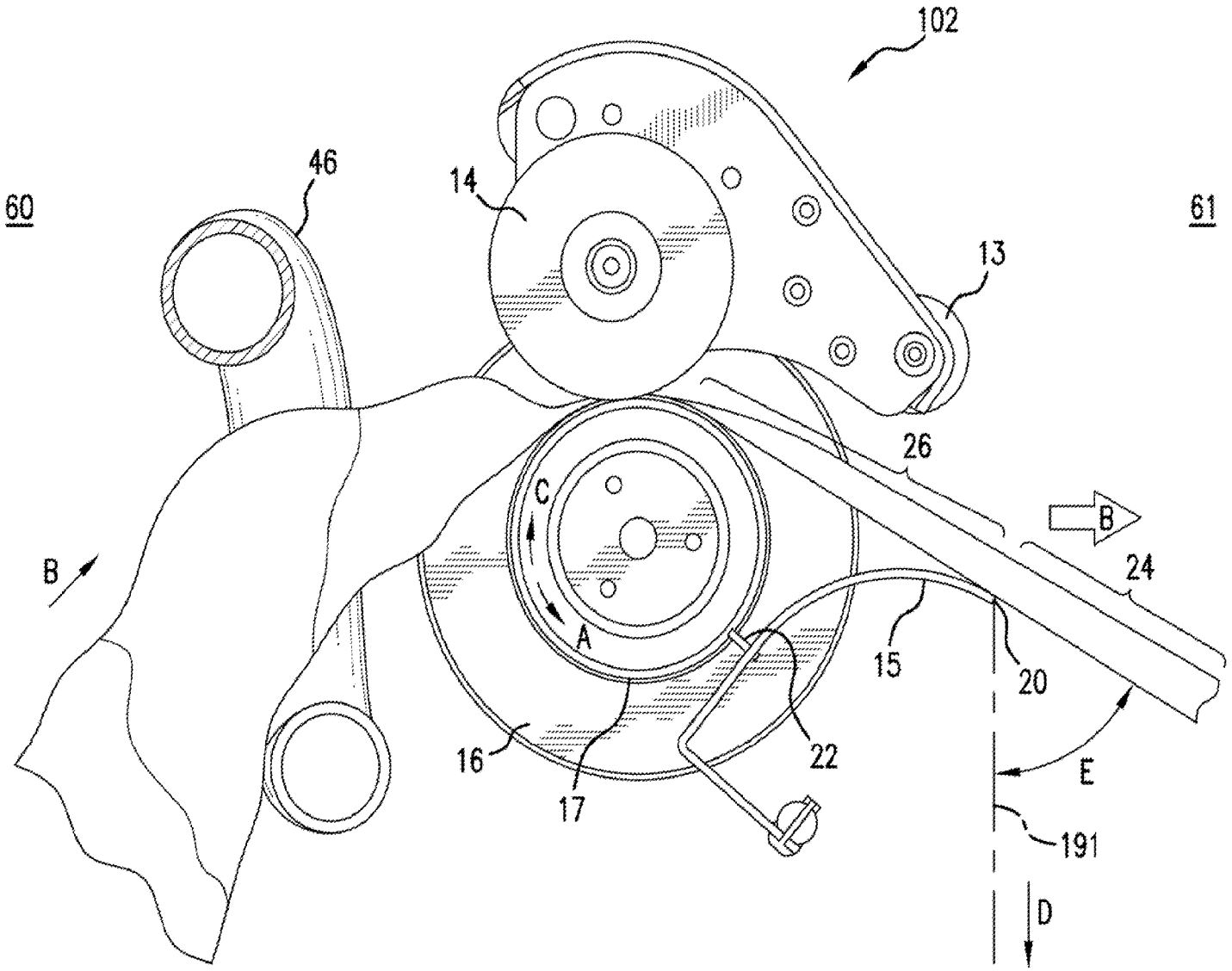
FIG. 3A is a side view of the system and apparatus of FIG. 2.

In one configuration, the system 10 can include a support portion for supporting the station and an inlet guide 12 for guiding the sheet material into the system 10. As shown in FIGS. 2 and 3A, the support portion and the inlet guide 12 are shown combined into a single rolled or bent elongate element forming a support pole or post. In this particular embodiment, the elongate element is a tube having a round pipe-like cross-section. Other cross-sections may be provided. In the embodiment shown, the elongate element has an outer diameter of approximately 1½". In other embodiments, the diameter may range from approximately ¾" to approximately 3" or from approximately 1" to approximately 2". Other diameters outside the range provided may also be used. The elongate element may extend from a floor base configured to provide lateral stability to the converting station. In one configuration, the inlet guide 12 is a tubular member that also functions as a support member for the system. In embodiments where a tube is provided, it can be bent around that central axis such that the longitudinal axis is bent about 250° to about 300°, to form a loop through which the line of material is fed.

Preferably, the system 10 also includes an actuator for driving the line of material 19. In the preferred embodiment, the actuator is an automatic or electric motor 11 or other motive device. The motor 11 is connected to a power source, such as an outlet via a power cord, and may be arranged and configured for driving the system 10. The motor 11 may be part of a drive portion, and the drive portion may include a transmission portion for transferring power from the motor 11. Alternatively, a direct drive may be used. The motor 11 may be arranged in a housing and may be secured to a first side of the central housing. The transmission may be contained within the central housing and may be operably connected to a drive shaft of the motor 11 and a drive portion thereby transferring motor 11 power.

During operation of the preferred embodiment, the motor 11 dispenses the line of material 19 by driving it in a dispensing direction, depicted as arrows "B" in FIG. 3. The motor 11 may be an electric motor in which the operation is controlled by a user of the system, for example, by a foot pedal, a switch, a button, or the like. The motor 11 is connected to a cylindrical driving drum 17, shown in FIG. 2, which is caused to rotate by the motor 11. The line of material 19 is fed from the supply side 61 of the converting station 102 and over the drum 17, thereby causing the line of material 19 to be driven in the dispensing direction "B" when the motor 11 is in operation.

In one embodiment, the system 10 includes a pressing portion that can also include a pressing member such as a roller, multiple rollers, or other similar elements. The rollers 14 may be supported via a bearing or other substantially frictionless device positioned on an axis shaft arranged along the axis of the rollers 14. Alternatively, the rollers can be powered and driven. The rollers 14 may have a circumferential pressing surface arranged in tangential contact with the surface of the drum 17. That is, for example, the distance between the drive shaft or rotational axis of the drum 17 and the axis shaft of the rollers 14 may be substantially equal to the sum of the radii of the drum 17 and the rollers 14. The rollers 14 may be relatively wide such as ¼ to ½ the width of the drum and may have a diameter similar to the diameter of the drum, for example.

In some embodiments, the roller 14 may have an approximately 2 inch diameter and an approximately 2 inch width. In some embodiments, the drum 17 may have an approximately 4-5 inch diameter 94 and an approximately 4 inch width. Other diameters of the rollers may also be provided. The roller diameter may be sufficiently large to control the incoming material stream. That is, for example, when the high speed incoming stream diverges from the longitudinal direction, portions of the stream may contact an exposed surface of the rollers, which may pull the diverging portion down onto the drum and help crush and crease the resulting bunching material. In the preferred embodiment, the motor 11 is connected to a cylindrical driving drum 17, which is caused to rotate by the motor 11. This embodiment can also include one or more drum guides 16 arranged on axial ends thereof in a lateral position relative to the feed direction. The drum guides 16 may help to guide the sheet material toward the center of the drum 17. The drum guide 16 may be operably connected to the drum 17 to rotate freely with or without the drum 17. As such, the drum guide 16 may be supported off of the drive shaft of the drum 17 via a bearing or other isolating element for allowing the drum guide 16 to rotate relative to the drum 17. In addition, the drum guide 16 may be isolated from the axial side of the drum 17 by an additional space, bearing, or other isolation element for minimizing the transfer of rotational motion from the drum 17 to the guide 16. In other embodiments, the outer drum guide 16 may be supported via a bearing off of the outer axial side of the drum 17 rather than off of the drive shaft, for example. While a drum 17 connected with an actuator 11 is disclosed in this embodiment as the driving portion for driving the line of material in the dispensing direction, it will be appreciated that other feed methods are possible, such as an automated motor.

Figure 3B:
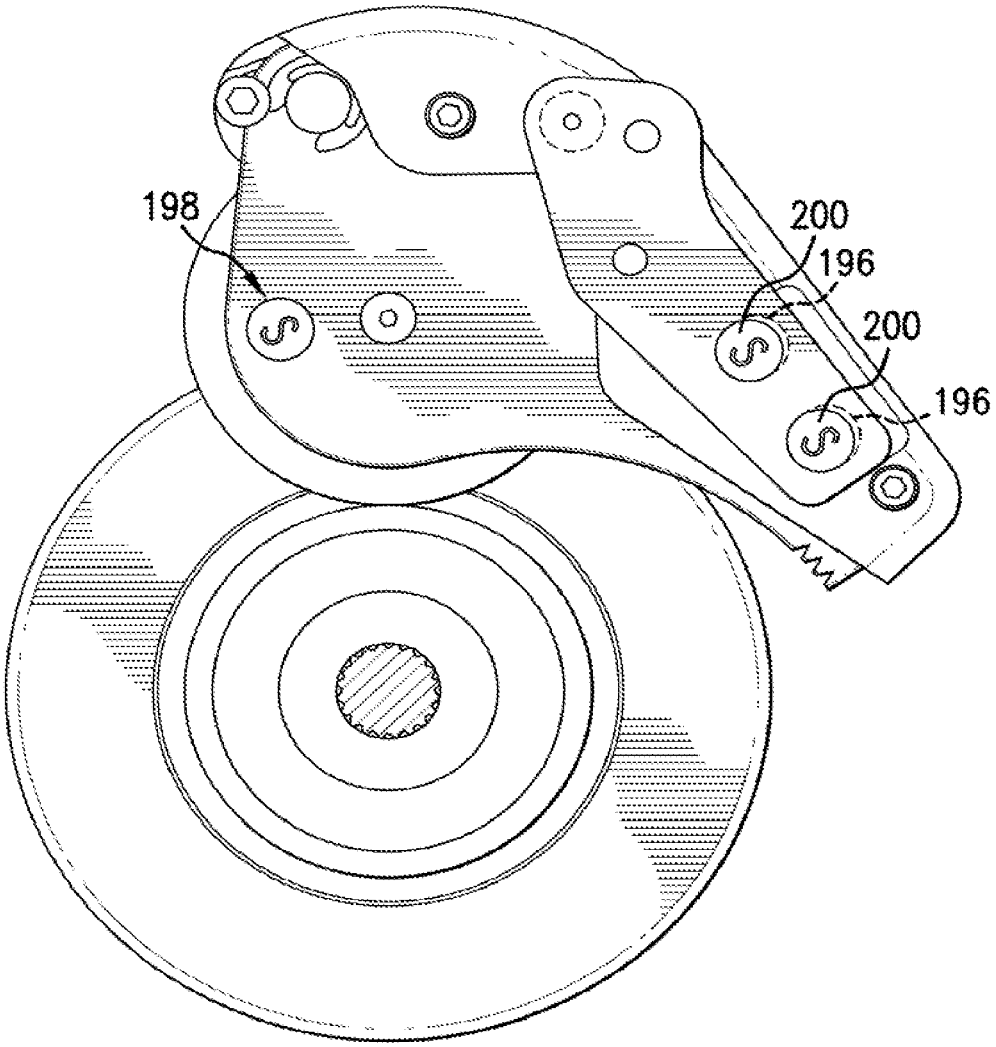
FIG. 3B is a cross-sectional view of the line processing system.

Referring to FIG. 3B, pressing member 14 having an engaged position biased against the drum 17 for engaging and crushing the sheet material 19 passing therebetween against the drum 17 to convert the sheet material. The pressing member 14 can have a released position displaced from the drum to release jams. The converting station 102 can have a magnetic position control system configured for magnetically holding the pressing member 14 in each of the engaged and released positions. The position control system can be configured for exerting a greater magnetic force for retaining the pressing member 14 in the engaged position than for retaining the pressing member 14 in the released position.

For example, the pressing portion 13, which can include a pressing member 13, can be disposed about a pivot axis such that, ignoring gravitational force, the pressing portion 13 is substantially free to pivot in a direction tending to separating the rollers 14 from the drum 17 about the pivot point. To resist this substantially free rotation, the pressing portion 14 can be secured in position by a position control system configured to maintain the rollers 14 in tangential contact with the drum 17, unless or until a sufficient separation force is applied, and hold the rollers 14 in a released position, once released. As such, when the material 19 passes between the drum 17 and the roller 14, the position control system can resist separation between the pressing portion 13 and the drum 17 thereby pressing the stream of sheet material and converting it into a low-density dunnage. When the rollers 14 are released due to a jam or other release causing force, the position control system can hold the rollers 14 in a released position allowing the jam to be cleared and preventing damage to the machine, jammed material, or human extremities, for example.

The position control system can include one or more biasing elements arranged and configured to maintain the position of the pressing portion 13 unless or until a separation force is applied. In the exemplary embodiment, the one or more biasing element can include a magnetic biasing element 196, as disclosed in U.S. Publication 2012/0165172. The magnetic biasing element 196, shown in FIG. 3B, is positioned behind magnets 200 disposed on the central housing. The magnetic biasing element 196 resists separation forces applied to the pressing portion 113. Additionally, the position control system can also include a release hold element 198, as shown in FIG. 3B, configured to hold the pressing portion 13 in the released open condition once the separation force has been applied and the pressing portion 13 has been released. In the exemplary embodiment, the released hold element can also be a magnetic holding element 198. It is noted that the nature of the magnets can provide the hold down force to require the minimum release force, that is the force applied to overcome the magnetic force of the biasing element, in a manner such that the hold-down force diminishes as the pressing portion 13 is separated from the drum 17. As such, the biasing force of the magnets can be substantially removed when the pressing portion 13 is pivoted to its released position.

Once in the pressing portion 13 is released, the magnets in the release hold element can function to hold the pressing portion 13 in the released condition. In one configuration, the force it takes to release the pressing portion 13 can be greater than the force required to place the pressing portion 13 back into an engaged position. This releasing mechanism can be advantageous to situations in which the user incorrectly positions the sticker on the supply unit, for example, and the supply units and sticker causes the converting station 102 to jam. In such situation, once the release force is reached due to the jam, the pressing portion 13 can release to a release position allowing for the user to easily remove the jam and preventing damage to the converting station 102.

In the preferred embodiment, the system further includes a tear-assist apparatus to facilitate the tearing or severing of the line of material 19. The tear assist facilitates moving the line of material in a direction opposite the pulling direction and toward the supply side 61 of the converting station 102, i.e. the reverse direction. Referring to FIG. 3A, as the line of material 19 is fed through the system in the material path "B", the drum 17 rotates in a converting direction (depicted as direction "C") and line 19 passes over a cutting member 15. The material path has a direction in which the material 19 is moved through the system.

Preferably, the cutting member 15 can be curved downward so as to provide a guide for the material in the outfeed portion of the path as it exits the system. Preferably, the cutting member 15 is curved at an angle similar to the curve of the drum 17, but other curvature angles could be used. It should be noted that the cutting member 15 is not limited to cutting the material using a sharp blade, but is can include a member that causes breaking, tearing, slicing, or other methods of severing the line of material 19. The cutting member 15 can also be configured to fully or partially sever the line of material 19.

Preferably the tear-assist apparatus comprises a single cutting member 15 that engages the line 19. The cutting member 15 can be is disposed on a single lateral side of the material path. In the preferred embodiment, it is disposed below the drum 17, and substantially along the material path. As shown in FIG. 2, the transverse width of the cutting member 15 is preferably about at most the width of the drum 17. In other embodiments, the cutting member 15 can have a width that is less than the width of the drum 17 or greater than the width of the drum 17. In the one embodiment, the cutting member 15 is fixed; however, it is appreciated that in other embodiments, the cutting member 15 could be moveable or pivotable as shown and described in FIG. 5 below.

The cutting member 15 of FIG. 3A includes a cutting edge 20 at the leading end thereof, which is oriented away from the driving portion. The cutting edge 20 is preferably configured sufficient to engage the line of material 19 when the line of material 19 is drawn in reverse, as described below. The cutting edge 20 can comprises a sharp or blunted edge, having a toothed or smooth configuration, and in other embodiments, the cutting edge 20 can have a serrated edge with many teeth, an edge with shallow teeth, or other useful configuration.

The cutting member 15 can also include a finger guard 22, as shown in FIG. 3A, which protects users from getting caught between the converting station 102 and cutting member 15. The finger guard 22 can also be used to prevent stray pieces of line material 19 from falling between the cutting member 15 and converting station 102, which could cause jamming of the converting station 102.

In operation, the user feeds a desired length of the line 19 at the supply side 60 of the converting station 102 which is then moved in a dispensing direction by the operation of the motor 11 and dispensed at the outfeed side 61. The drum 17 turns in coordination therewith, and the line 19 is fed out of the machine until a desired length has been reached. At this point, the operator stops the motor 11, and dispensing movement of the line 19 stops. The user then pulls on the line 19 in a "D" direction that is downward and in the outward direction from the supply side 60 so as to engage the line with the cutting member 15. Direction "D" is defined as the direction tangent to the drum 17, preferably at 90° to the axis of the drum which is illustrated as line 191 in FIG. 3A.

As an illustrative example shown in FIG. 3A, the line of material 19 follows a material path. As discussed above, the material path has a direction in which the material 19 is moved through the system. The material path can be broken up into separate segments: feed path, outfeed path, and severable path. In the embodiment shown in FIG. 3A, the line of material 19 on the outfeed side 61 substantially follows the path of the cutting member 15 until it reaches the cutting edge 20. The cutting edge 20 provides a cutting location at which the line is severed. In the embodiment shown in FIG. 3A, the material path can be bent over the cutting edge 20. The line of material 19 on the outfeed side of the converting station 102 can be broken into two portions at the point in which the material path is bent or the cutting edge 20: an outfeed portion 26 that is disposed between the drum 17 and cutting member 15 and a severable portion 24 that is disposed beyond the cutting member 15.

The user pulls at the severable portion 24 of the line of material 19 in an outward direction from the supply side 60, which is illustrated as line 191 in FIG. 3A, and in a direction "D" which is tangent to the drum 17. By pulling the line of material 19, the user triggers the tear-assist apparatus, which then moves the line of material 19 in a reverse direction. The reverse direction can be defined as the direction opposite the dispensing direction or pulling direction. Where a cutter 15 is provided, the tear-assist apparatus pulls the line 19 in reverse to engage with the cutter to more easily sever the line. In one exemplary embodiment, when the line of material 19 is reversed, the cutting edge 20 of the cutter 15 engages with the line of material 19 such that the force being applied by the user in the direction "D" and by the reverse motion cooperatively partially or fully sever the line of material 19 at the cutting edge 20. As illustrated in FIG. 3A, the angle "E" at which the user holds the line of material 19 facilitates the engagement of the cutting member 15 with the line of material 19. Angle "E" is defined as the angle between the dispensing direction of line of material 19 at the cutting edge 20 and the position the severable portion 24 being held by the user. The severable portion 24 can also be, in some embodiments, the end portion of the line of material 19. Preferably, the angle "E" at which the user pulls the severable portion 24 of the material 19 is about 15°, more preferably angle "E" is about 75°, and most preferably the angle "E" is at most about 130°.

In the preferred embodiment, the reverse movement of the line of material 19 and the pull of the line 19 in a direction outward from the supply side 60 cooperatively engages the line 19 with the cutting edge 20 such that the line partially or fully severs. In other embodiment, the cutting edge 20 sufficiently catches the line of material 19, for example caused by teeth or another element, such that the force of the reverse movement and the resistance caused by the cutting edge 20 causes the line of material 19 to partially or fully sever. For example, in some configurations the teeth at the cutting edge 20 catches or engages the line of material 19 by partially piercing through the material 19 at the pointed tip of the teeth. In other configurations, for example when the cutting edge 20 has no teeth, the cutting member catches and engages the line of material 19 as the line 19 is pulled in the reverse direction, for example causing it to tear. In some embodiments, sufficient force needs to be applied to the severable portion 24 by the user in order to catch the cutting edge 20 with the line of material 19. In some configurations, the reverse movement on the line of material 19 may be sufficient to partially tear the line 19 or completely tear the line 19. In one embodiment, the reverse movement pulls a slightly distance such that the line 19 creates a weakened area or a partial tear. In other embodiments, the reverse movement pulls the line of material 19 sufficiently enough to cause the line 19 to tear.

In other embodiments of the cutting member 15, the member can be a bar that sufficiently engages the line of material 19 such that both the force of the user pulling in one direction and the force of the tear assist pulling the line of material 19 in a reverse direction cooperatively partially or fully tears. It should be appreciated, however, that a cutting member does not need to be present, for example where the line is perforated, the tear-assist can function to assist the user to sever the line at the perforation.

In one embodiment of the tear assist apparatus, the reverse movement of the line can be caused by an actuator, or preferably a motor 11. In this embodiment, the drum 17 can rotate in a reverse direction (depicted as direction "A") to cause the line 19 to move in the reverse direction toward the supply side of the converting station 102. In one embodiment, as the drum 17 rotates in reverse, a portion of the converted line of material 19 can be reversed back under the pressing members.

Preferably, the drum 17 is connected to the motor 11, which is the same motor 11 that moves the line of material 19 in the dispensing direction. In an another configuration, there are multiple actuators where one moves the line of material 19 in a dispensing direction and the another separate actuator moves the line of material in a reverse direction. Alternatively, one or more other drums may be used, which may be connected to one or more other actuators, to cause reverse movement. In one embodiment, the reverse movement is caused by a spring or other mechanical member.

The sensor is configured to detect parameters reflective of the user pulling the severable portion of the dunnage out from the device and against the blade. In this embodiment, the sensor is configured to detect the current induced in the motor 11 by the dunnage pulling the motor 11 in a forward direction. Upon detecting the minimum current, which is reflective of the a minimum speed and/or distance of the dunnage being pulled out of the machine that is commenced of a user pulling by hand. Thereby activating the motor in reverse. Preferably, the user will pull the severable portion at an angle against the blade at a force about at least ½ lb, more preferably the force is about at least 1 lb, and most preferably, the force is about at least 2 lbs. Preferably, the force is about at most 10 lbs, and more preferably the triggering force is about at most 4 lbs.

In an embodiment, the sensing unit is configured to detect parameters reflective of a pulling initiated only by the user, and not from another part of the device or due to residual motion of the converting station 102. Thus, while the converting station 102 is in operation, the motion of the driving portion, dispensing of the line of material 19, or other motions will not cause the sensing unit to trigger the tear assist apparatus.

In one embodiment of the sensing unit, when the appropriate trigger force is applied to the line of material 19, the sensing unit sends a signal to the driving portion to initiate a short rotational movement in the direction opposite the dispensing direction, thereby causing the line 19 to be pulled in a reverse direction. As discussed above, this reverse motion and the pulling by the user cooperatively engages the line of material 19 with the cutter 15 causing the line of material 19 to partially or fully tear or sever. The tear-assist thereby assists the user in tearing the line. In one embodiment, this short reverse impulse causes the line 19 to engage more directly with the cutting edge 20 of the cutting member 15, and as such assists the user in tearing or severing the line 19. The cutting edge 20 sufficiently catches the line of material 19 such that the reverse pull caused by the driving portion provides a tear-assist force, and decreases the force required by the user pull in order to sever the line 19.

In some embodiments, the reverse rotational pulse initiated by the motor 11 may be less than a millisecond in duration, or less than 10 milliseconds in duration, or less than 100 seconds in duration. In some embodiments, the line 19 may be pulled along the material path opposite the dispensing direction toward the supply side of the converting station by at least about 0.25 inches, 0.5 inches, 1 inch, 2 inches, or 5 inches, or more during the cutting operation. In the preferred embodiment, the line 19 is pulled into the opposite direction toward the supply side at a sufficient distance, preferably about ½ inch to an inch, such that the converted line of material 19 is not pulled so far toward the supply side that it disengages with the converting station 102, and thus requiring the material 19 to be reloaded onto the converting station 102.

In another embodiment, the sensing unit detects the pulling motion by the sensing of electric current or voltage in the motor 11 while not in operation. For example, as the user pull the line 19, the drum 17 is caused to rotate, which in turn causes the motor to rotate. This rotation of the motor 11 induces an electric current therein, which may be detected by the sensing unit. At this point, the sensing unit causes the motor to operate, as discussed above, in the direction opposite the dispensing direction. In an alternate embodiment, pull motion is detected by the sensing unit using mechanical members, for example a switch or button or like member is engaged and caused to be moved when the line 19 is pulled, such movement being detectible by the sensing unit.

As discussed above, in the preferred embodiment, the supply material is a line of material 19, such as preferably a line of sheet material. The sheet material preferably has a basis weight of about at least 20 lbs to about at most 100 lbs. Preferably, the line of material 19 comprises paper stock stored in a high-density configuration having a first longitudinal end and a second longitudinal end, that is later converted into a low-density configuration. In the preferred embodiment, the line of material 19 is a ribbon of sheet material that is stored as coreless rolls, as shown in FIG. 1, where the first longitudinal end is the inner end 12 of the roll, and the second longitudinal end is the outer end 114 of the roll extending therefrom and opposite the outer end 114. The rolls are formed by winding the ribbon of sheet material upon itself to create multiple layers and preferably leave a hollow center. The axial height of the rolls is preferably about at least 5". The axial height 38 of the rolls is preferably about up to 80". The outer diameter of the rolls is preferably about at least 5". The diameter 39 of the rolls is preferably about up to 24". The inner diameter of the center of the roll 4 is typically about at least 2" or at least 3". The diameter of the center of the roll is typically about up to 8", more preferably up to about 6" or 4". Other suitable dimensions of the supply rolls can be used. In one example embodiment of the rolls, the outer diameter 39 of the roll is about between 11" to 12¼", and the inner diameter 41 is about 3" to 6".

The sheet of material may be made of a single ply or multiple plies of material. Where multi-ply material is used, a layer can include multiple plies. It is also appreciated that other types of material can be used, such as pulp-based virgin and recycled papers, newsprint, cellulose and starch compositions, and poly or synthetic material, of suitable thickness, weight, and dimensions.

In one embodiment, as shown in FIG. 1, the rolls comprise a sticker 6 having a connecting member 16 and a base member 18, which are longitudinally adjacent to each other, as well as a release layer 20. Preferably, the sticker facilitates daisy chaining the rolls together to form a continuous stream of sheet material that can be fed into the converting station 102. For example, as illustrated in FIG. 1, the inner end of the lower roll is adhered to the outer end of an upper roll stacked directly upon the lower roll. The inner end 12 of the upper roll is fed into the converting station 102. As the upper roll is exhausted, the sticker 6 pulls the inner end 12 of the lower roll into the converting station 102, thereby creating a continuous stream. It is appreciated, however, that the supply material can be arranged in various configurations. For example, more than two rolls could be daisy-chained together, or only one roll could be loaded into the system 10 at a time, or the supply material can be arranged in a fan-folded stack, etc. In other configurations, the daisy chained rolls can be held within a stabilizer 52, as shown in FIG. 1. The exemplary stabilizer 52 shown includes an opening in the front to allow users to, for example, identify the rolls as well as detail loading and operating instructions written, for example, on the sticker 6. In one embodiment of the supply handling unit, multiple stabilizers 52 can be stacked, and the rolls within the stacked stabilizers 52 are daisy-chained together. In one embodiment of the stabilizer 52, the stabilizer 52 maintains the shape of the rolls, and keep the rolls from collapsing when only a few layers are left in each roll, such by gently applying compressive pressure to the outer surface of the rolls, Preferably, as the material 19 is being fed into the converting station 102 as a coiled stream. It is appreciated, however, that the material may not be oriented as a coil, but in alternative embodiments, could be folded, crumpled, flat without any coil, fold, or crumple, or could have other similar configurations. The preferred width 30 of the material being fed through the converting station 102 is about at least 1", more preferably about at least 2", and most preferably about at least 4". The preferred width 30 of the material being fed through the converting station 102 is about up to 30", and more preferably about up to 10". The preferred dimensions of the material being fed through the converting station 102 is about at least ½" thick. The preferred dimension of the material being fed through the converting station 102 is about up to 3" thick, and more preferably about up to 2" thick.

Figure 4:
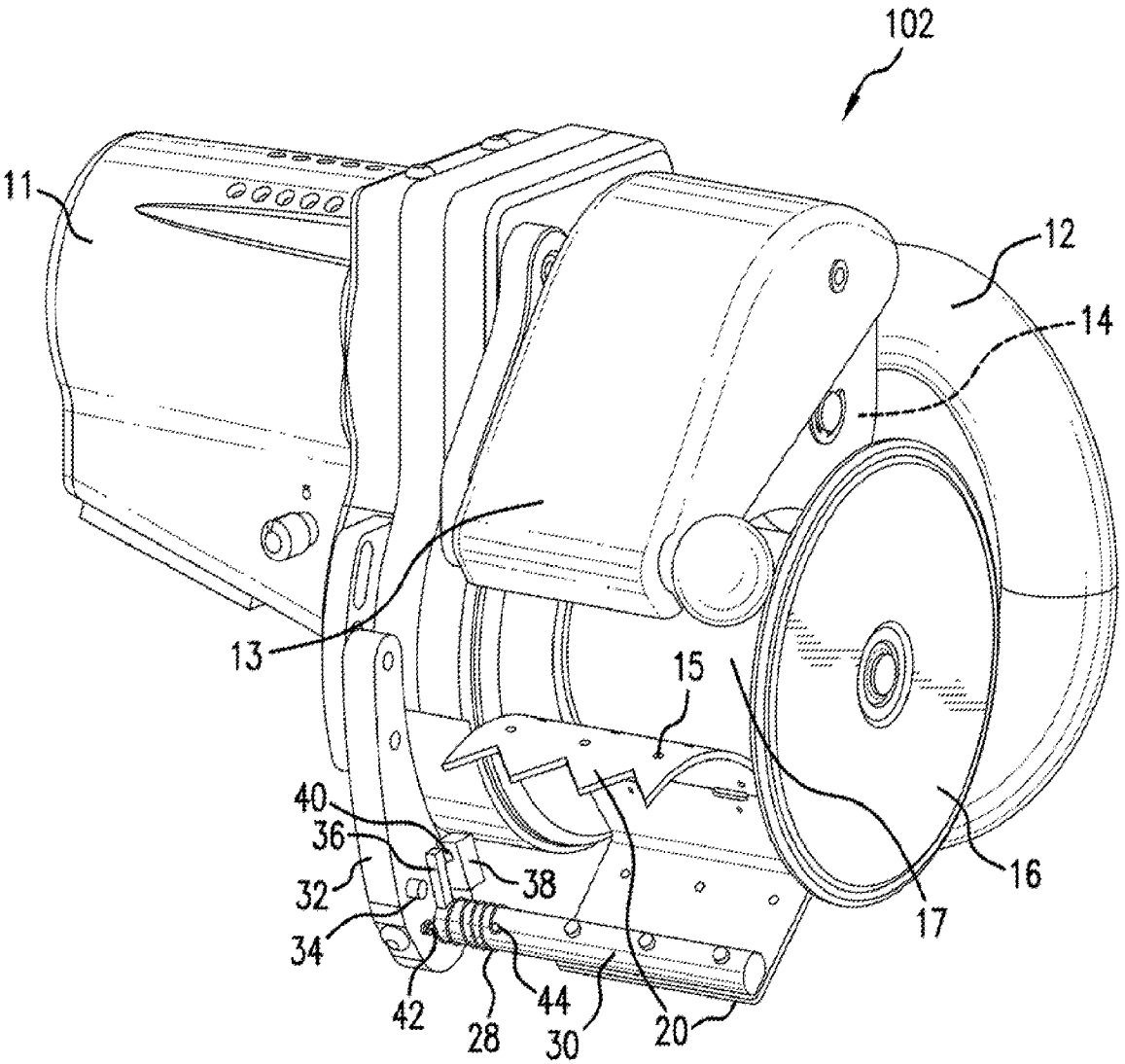
FIG. 4 is a front view of another embodiment of a line processing system with a tear assist apparatus employed thereon in accordance with the present disclosure.

FIG. 4 depicts another embodiment of the system 10 including the tear-assist apparatus. In this embodiment, the sensing unit comprises a spring 28, stop 34, trigger button 40, sensor 38, and sensing lever 36. The cutting member 15 is positioned on a pivoting shaft 30 that allows the cutting member 15 to move in an outward direction away from the supply side 60 when a user pulls at the line of material 19. The cutting member 15 can move by displacing the position of the cutting member 15, by pivoting the cutting member, or by other similar movement of the cutting member 15. The pivoting shaft 30 extends the traverse width of the cutting member 15 and is pivotably mounted on a support bracket 32. A spring 28 is coiled about the pivoting shaft 28, and is affixed to the pivoting shaft 30 at the spring shaft end 44. The spring 28 is also affixed to the support bracket 32 at the spring support end 42 opposite the spring shaft end 44. A lever 36 is affixed perpendicular to the axis of the pivoting shaft 30, as shown in FIG. 4, and positioned between the stop 34 and the sensor 38. In the rest position, which is defined as the position in which the tear-assist apparatus is not in use and the converting station 102 is either at rest or dispensing the material 19 in a dispensing direction, the cutting member 15 is positioned biased toward the drum 17 and the lever 40 is sufficiently pressing against the trigger button 40 of the sensor 38. While the trigger button 40 is in its pressed position, the tear-assist apparatus is not activated. Once the lever 40 is lifted from the trigger button 40, that is no longer resting on the trigger button 40, the sensor 38 is activated, and thereby activating the tear-assist apparatus, which pulls the line of material 19 in a reverse direction. In this embodiment, the sensor 38 can be a switch, such as a microswitch, but other types of sensors can also be used.

Figure 5:
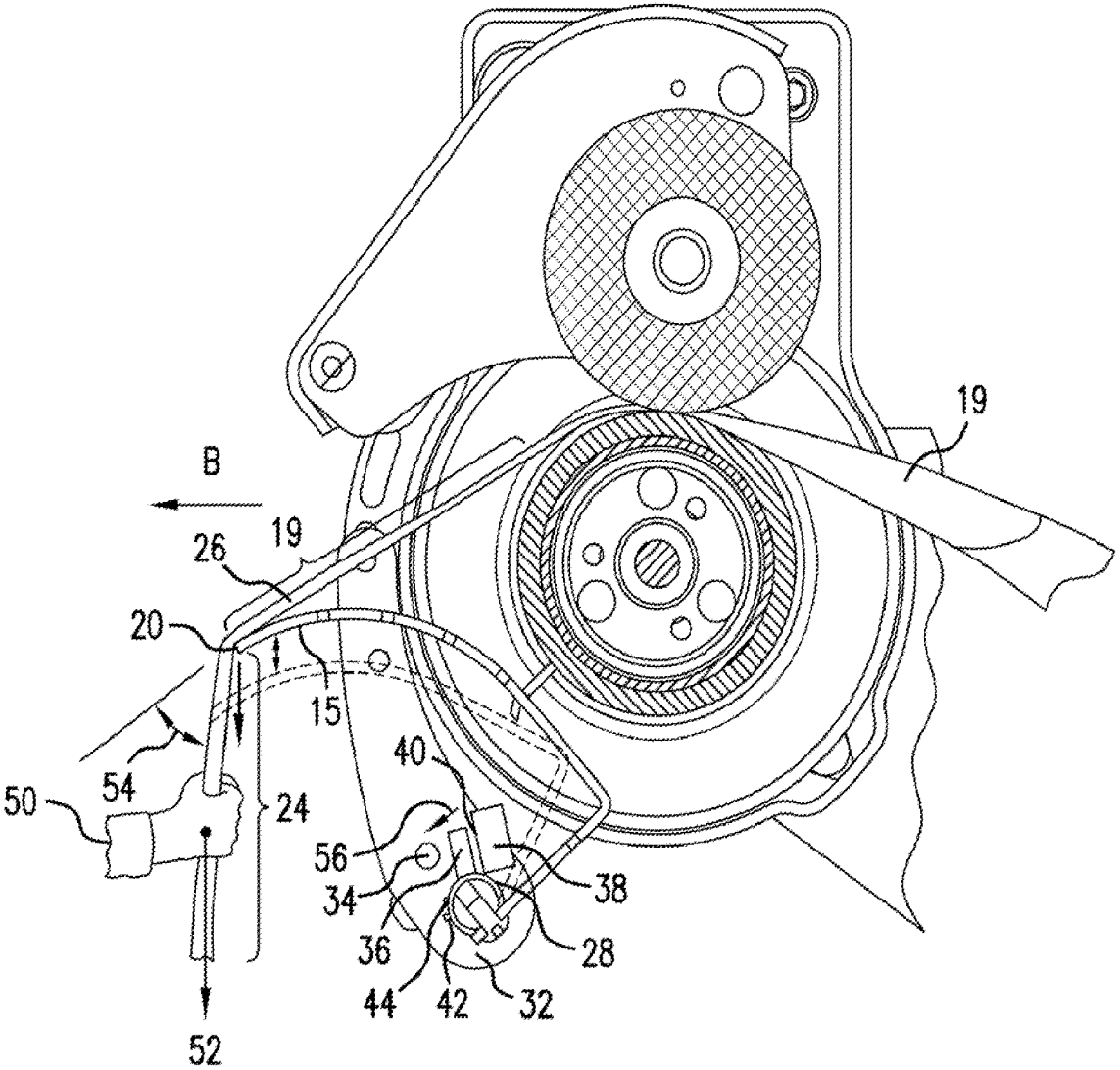
FIG. 5 is a side view of the system and apparatus of FIG. 4.

As shown in FIG. 5, during operation of this embodiment, the converting station 102 is converting and dispensing line of material 19 in a dispensing direction "B". The user 50 (which is shown only by the hand) stops operation of the converting station 102, and holds the line of material 19. As discussed above, the user 50 preferably holds the severable portion 24 of the line of material 19. The user 50 preferably pulls the material 19 in a direction outward and substantially down relative to the dispensing direction. Preferably, the user 50 pulls the material 19 at an angle 54 with respect to the outfeed portion 26 about the cutting edge 20. Preferably the user 50 pulls the material 19 at an angle 54 that is about at least 15°, more preferably about at least 30°, and most preferably about at least 45°. Preferably, the user 50 pulls the material 19 at an angle 54 that is about at most 110°, and more preferably about at most 90°. The pull of the user 50 on the line of material 19 creates a downward force 52 on the cutting member 15 causing the cutting member 15 to pivot about the pivot shaft 30. This is shown as the phantom lines in FIG. 5.

The sensor 38 in this embodiment can be configured to detect parameters reflective of the user pulling the severable portion 24 of the dunnage out from the device and against the cutting member. In this embodiment, the sensor is configured to detect the displacement, for example the rotation of the cutting member about its pivot, that changes the state of the sensor, such as a switch. For example, as the cutting member 15 is pivoted downward, the lever 36 is released or lifted from the trigger button 40. Upon detecting the minimum displacement of the cutting member, which is reflective of a user pulling by hand, the motor is activated causing reverse movement on the line of material 19. Preferably the force required to displace the cutting member is about at least ½ lb, more preferably the force is about at least 1 lb, and most preferably, the force is about at least 2 lbs. Preferably, the force is about at most 10 lbs, and more preferably the triggering force is about at most 4 lbs. As discussed above, this reverse movement and the force 52 applied by the user 50 cooperatively causes the line of material 19 to engage the cutting edge 20 and fully or partially tear or sever the line of material 19. Preferably there is a predetermined distance between the stop 34 and the sensor 38. This predetermined distance prevents the cutting member 15 from being pulled too far outwardly away from the supply side.

Figure 6:
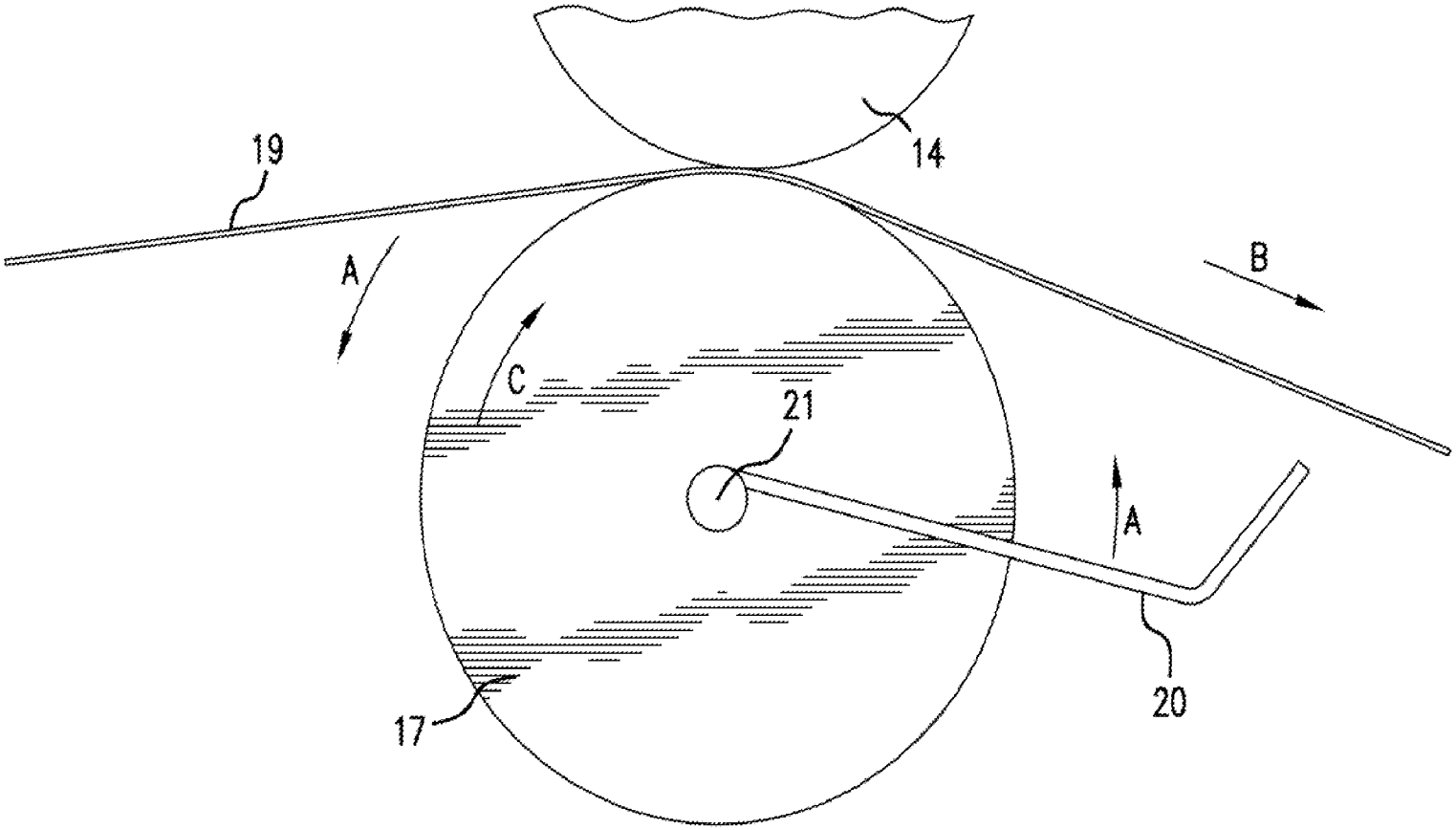
FIG. 6 depicts an embodiment of a tear assist apparatus including a driven cutting member.

FIG. 6 depicts an alternative embodiment of the system 10 with tear-assist apparatus. In this embodiment, an alternatively configured cutting member 20 is angled upwardly at near its cutting end as shown. It is connected at its connection end 21 to the central axis of the drum 17. The connection point 21 includes a one-way clutch that allows the cutting member to remain in the position shown during dispensing operations (direction "B"). However, when the reverse direction is initiated upon pulling of the line 19, the one-way clutch at connection 21 engages to cause the cutting member 20 to rotate upward as the drum 17 rotates in reverse directly, as indicated by arrow "A". In this manner, the cutting member 15 is driven upwardly in to the line 19 as the line 19 is pulled back into the cutting member 20, thereby increasing the cutting force provided by the tear-assist, and decreasing the force required by the user pull in order to sever the line 19.

Figure 7:
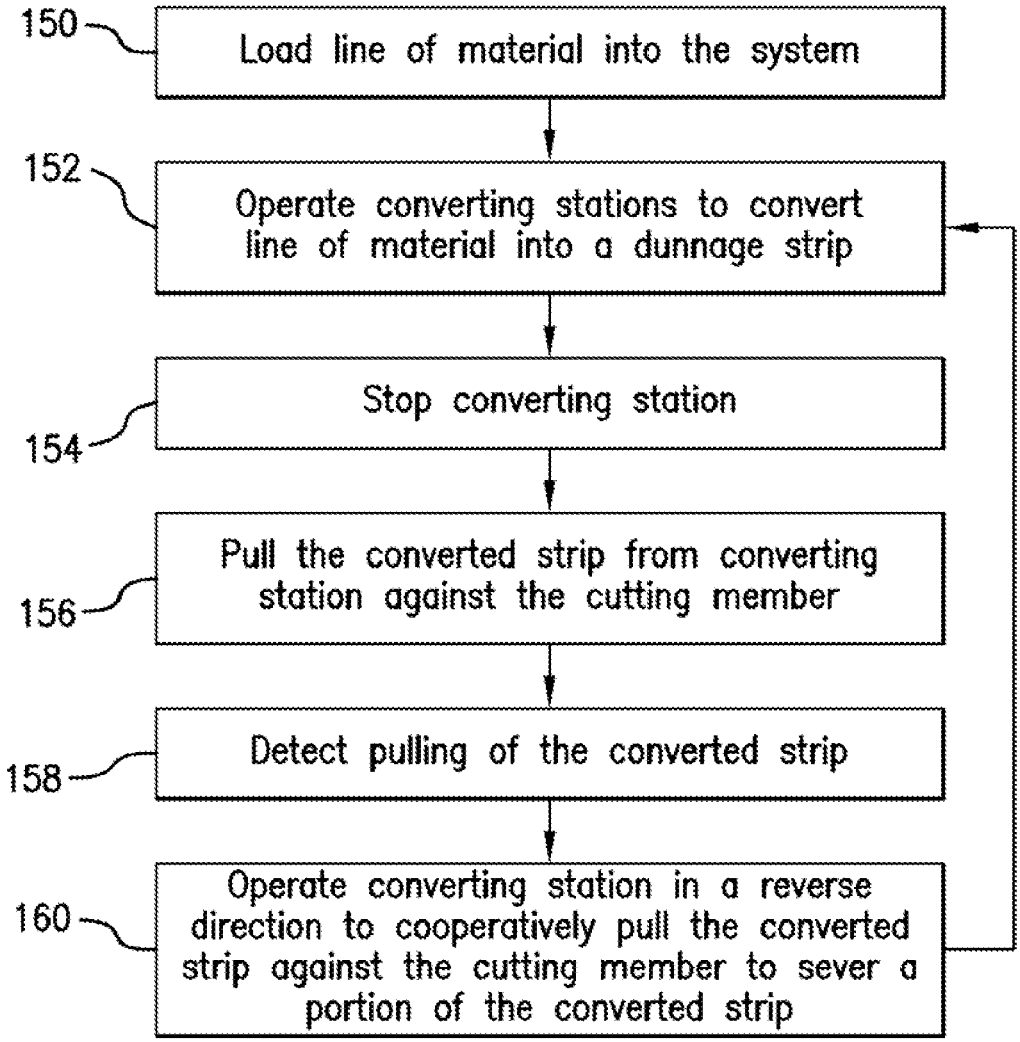
FIG. 7 depicts a flow diagram of operating the tear-assist apparatus.

An illustrative flowchart of a method for operating the tear-assist application is depicted in FIG. 7. In step 150, the line of material 19 is loaded into the system 10. The line of material 19 can be arranged in rolls, a stack of sheet material, or any of the arrangements described above. The material 19 is fed into the converting station 102 through the supply side 61. In step 152, the user operates the converting station 102 to convert the line of material 19 into a dunnage strip. The converting station 102 dispenses the line of material 19 at the outfeed side of the converting station 102 along a dispensing direction or path. The user stops the converting station 102 in step 154. At this point, the severable portion 24 of the line of material 19 is pulled from the converting station and against the blade in a direction outward from the supply side, and preferably in a direction "D" as shown in FIG. 3A and discussed above. The sensing unit detects the pulling of the line of material 19 in step 158. As discussed above, in some embodiments, the sensing unit triggers the tear-assist apparatus when downward force applied to the cutting member reaches a threshold, for example 2 lbs. In other embodiments, a controller 1000 (shown in FIG. 8) may be configured to control tear-assist apparatus, where input from the sensing unit 31 to the controller 1000 triggers the tear-assist apparatus. The input from the sensing unit 31 to the controller could be a current, or a displacement of the cutting member, or other similar type of inputs. In step 160, the controlling station 102 operates in the reverse direction to cooperatively pull the converted strip against the cutting member 15 to sever a portion of the converted strip. As discussed above, the converted strip or line of material 19 is pulled in a reversed direction toward the supply side of the converting station 102 while also being pulled in against the cutting member 15 in a direction outward the supply side of the converting station 102 to cooperatively partially or fully tear the line of material 19.

Figure 8:
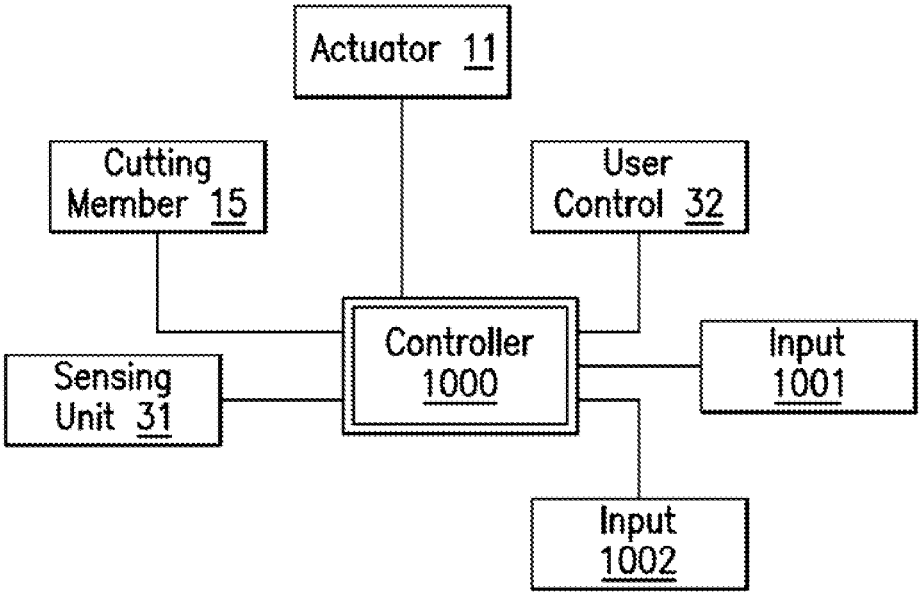
FIG. 8 depicts a system diagram of a tear-assist apparatus in accordance with the present disclosure.

With respect to any of the embodiments above, as shown in FIG. 8, a controller 1000 may be included and configured to control the tear-assist apparatus. Input to the controller 1000 may be from a sensing unit 31, the actuator 11, user controls 32, the movement of the cutting member 15, or any other component, represented schematically as one or more inputs 1001, 1002, etc. Controller 1000 may include, but is not limited to, a computer/processor that can include, e.g., one or more microprocessors, and use instructions stored on a computer-accessible medium (e.g., RAM, ROM, hard drive, or other storage device).

The controller 1000 may also include a computer-accessible medium (e.g., as described herein above, a storage device such as a hard disk, floppy disk, memory stick, CD-ROM, RAM, ROM, etc., or a collection thereof) can be provided (e.g., in communication with a processing arrangement). The computer-accessible medium can contain executable instructions thereon. In addition or alternatively, a storage arrangement can be provided separately from the computer-accessible medium, which can provide the instructions to the processing arrangement so as to configure the processing arrangement to execute certain exemplary procedures, processes and methods, as described herein above, for example.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A dunnage converting apparatus, comprising:

a converting station operable in a converting direction for converting supply material into low-density dunnage and moving the dunnage in a dispensing direction along a material path;

a cutting member disposed on a single lateral side of the material path, the cutting member dividing the path and dunnage therein into:

an outfeed portion between the converting station and the cutting member, and a severable portion beyond the cutting member from the converting station; and a reverse-driving element that is operable to pull the dunnage against the cutting member to cause the cutting member to initiate a cut of the dunnage at the cutting member.

2. The dunnage converting apparatus of claim 1, wherein the converting station comprises the reverse-driving element, which is operable in a reverse direction to pull the dunnage against the cutting member.

3. The dunnage converting apparatus of claim 2, wherein the converting station is operable in the reverse direction when the severable portion of the dunnage is pulled such that the path is bent at the cutting member so that the outfeed and severable portions are out of alignment.

4. The dunnage converting apparatus of claim 1, wherein the cutting member cuts the dunnage when the dunnage in the severable portion is bent around the cutting member.

5. The dunnage converting apparatus of claim 1, wherein the cutting member comprises a blade that cuts through the material upon the reverse driving element pulling the dunnage there against.

6. The dunnage converting apparatus of claim 1, wherein the cutting member includes a cutting edge facing away from the reverse-driving element, such that the dunnage is pulled against the cutting member when the dunnage is bent about the cutting edge.

7. The dunnage converting apparatus of claim 1, free of a corresponding cutting member disposed opposite of the cutting member.

8. The dunnage converting apparatus of claim 1, wherein the cutting member comprises a blade extending laterally next to the path.

9. The dunnage converting apparatus of claim 1, wherein the cutting member comprises teeth that pierce through the material upon the reverse driving element pulling the dunnage against the cutting member.

10. The dunnage converting apparatus of claim 9, wherein the line of material is free from perforations.

11. The dunnage converting apparatus of claim 1, wherein upon the reverse driving element pulling the dunnage against the cutting member, the cutting member cuts the dunnage by creating a weakened area or partial tear in the material.

12. The dunnage converting apparatus of claim 1, wherein upon the reverse driving element pulling the dunnage against the cutting member, the cutting member severs the material so to separate the outfeed portion from the severable portion.

13. The dunnage converting apparatus of claim 1, wherein the reverse-driving element is operable to pull the dunnage against the cutting member when the dunnage is pulled by an external force.

14. A dunnage converting apparatus, comprising:

a converting station operable in a converting direction for converting a line of material from supply material into low-density dunnage and moving the dunnage in a dispensing direction along a material path; and a cutting member dividing the path and dunnage therein into:

an outfeed portion between the converting station and the cutting member, and a severable portion beyond the cutting member from the converting station;

wherein the converting station is operable in a reverse direction to pull the dunnage against the cutting member to cause the cutting member to initiate a cut of the material at the cutting member.

15. The dunnage converting apparatus of claim 14, wherein the cutting member comprises teeth that pierce through the material upon the converting station pulling the dunnage against the cutting member.

16. The dunnage converting apparatus of claim 14, wherein upon the converting station pulling the dunnage against the cutting member, the cutting member severs the material so to separate the outfeed portion from the severable portion.

17. The dunnage converting apparatus of claim 14, wherein the cutting member is disposed on a single lateral side of the material path, free of a corresponding cutting member disposed opposite of the cutting member.

18. The dunnage converting apparatus of claim 17, wherein the cutting member comprises a blade extending laterally next to the path.

* * * * *